United States Patent [19]

Stone

[11] 3,973,724

[45] Aug. 10, 1976

[54] TWIST-TOP CONTAINER

[76] Inventor: Laurie Stone, 1058 Glenlake, Chicago, Ill. 60660

[22] Filed: Sept. 12, 1975

[21] Appl. No.: 612,774

[52] U.S. Cl. ..... 229/39 R; 229/41 C; 229/43

[51] Int. Cl.[2] ..... B65D 5/08

[58] Field of Search ..... 229/43, 39 R, 41 C

[56] References Cited

UNITED STATES PATENTS

| | | | |
|---|---|---|---|
| 1,431,918 | 10/1922 | Arthur | 150/3 |
| 3,107,042 | 10/1963 | Keith | 229/43 X |
| 3,237,840 | 3/1966 | Keith | 229/41 C |
| 3,254,826 | 6/1966 | Keith | 229/43 X |

*Primary Examiner*—Davis T. Moorhead

*Attorney, Agent, or Firm*—Hume, Clement, Brinks, Willian, Olds & Cook, Ltd.

[57] ABSTRACT

A container constructed from a single pre-cut blank whose closure structure operates to close or open the container in response to rotation of the closure structure relative to the container's base walls.

5 Claims, 16 Drawing Figures

P
J
J
40
A1
A2
An+1
S
B1
B2
Bn+1
X
F1
F2
Fn
α
C1
C2
Cn
inradius
D1
D2
Dn+1
T
E1
E2
En+1
J

U/2
U/3
60°
Y

A1
A2
A3
A4
U
S
X+inrad.-T
2
B1
Y
B2
B3
B4
G
G1
K1
G2
K2
G3
K3
K
X
F1
F2
F3
C1
C2
C3
inradius
D1
D2
D3
D4
T
E1
E2
E3
E4

TWIST-TOP CONTAINER

BACKGROUND AND SUMMARY OF THE INVENTION

The present invention relates, generally, to containers and, more specifically, to a new closure structure and to containers, cartons and the like utilizing such a closure.

A variety of containers and associated closing structures are well known in the art. Many of these may be constructed from a single pre-cut blank. Examples of such containers are disclosed in U.S. Pat. Nos. 2,843,308, 3,107,042, and 3,254,825. In these containers the closure structure operates to open or close in response to forces applied normal to the plane of the closure when closed; that is, telescoping of the side walls operates to open and close the top of the container.

The present invention is characterized by a novel arrangement of side panels and apertures which operates to form a closure structure or access passageway for the container in response to rotation of the upper portion of the container relative to the lower portion thereof.

Containers employing the novel design of the present invention can be constructed from a single pre-cut blank such that the container is a one-piece unit. Moreover, containers having an even number of sides may be collapsed to form a generally flat package even after substantially complete assembly from the cut blank. Thus, the container may be conveniently and economically shipped or stored either before or after use.

BRIEF DESCRIPTION OF THE DRAWINGS

The novel features believed to be characteristic of the present invention are set forth in the appended claims. The invention itself, however, together with further objects and attendant advantages thereof, will be best understood by reference to the following description taken in connection with the accompanying drawings, in which:

DETAILED DESCRIPTION OF THE PREFERRED EMBODIMENTS

Figure 1:
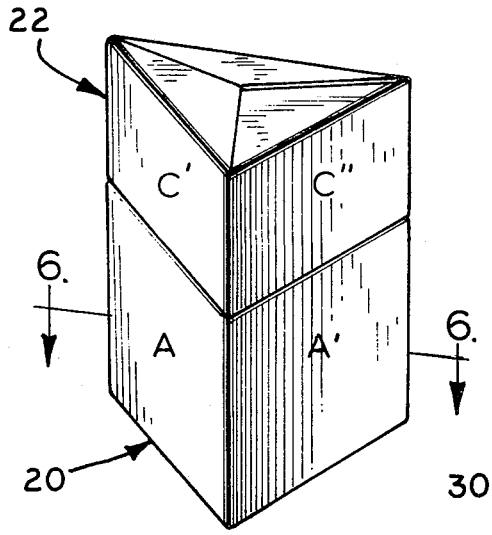
FIG. 1 is a perspective view of a closed container illustrating one embodiment of the present invention.
Figure 2:
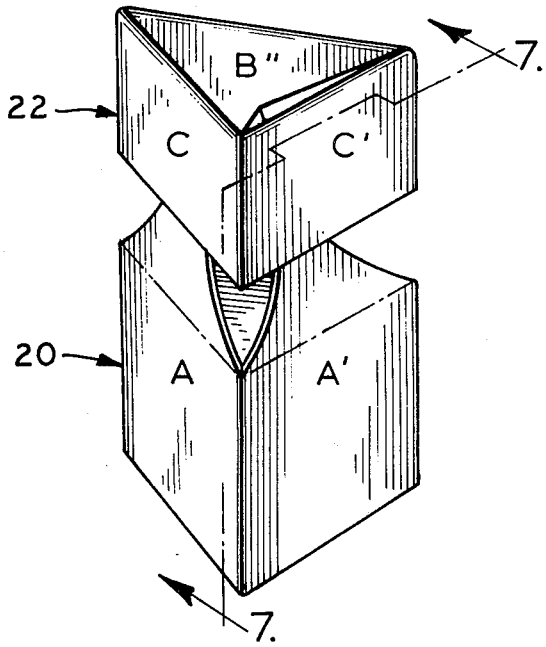
FIG. 2 is also a perspective view showing the same container of FIG. 1 in the open position.
Figure 3:
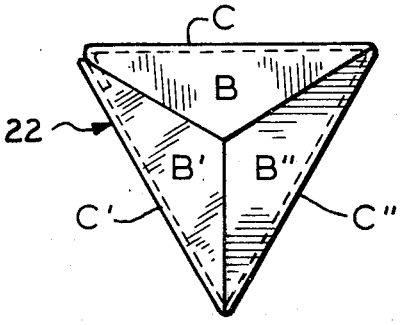
FIG. 3 is a top view of the container shown in FIG. 1.
Figure 6:
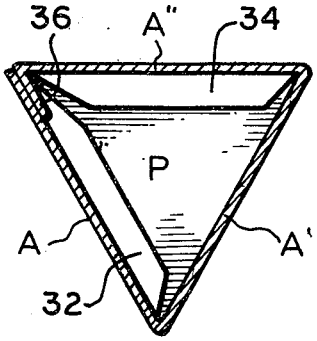
FIG. 6 is a cross-sectional view taken along line 6—6 of FIG. 1.
Figure 8:
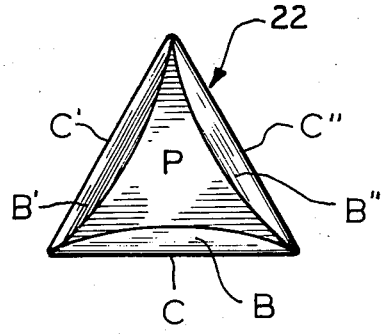
FIG. 8 is a top view of the open container shown in FIG. 2.
Figure 9:
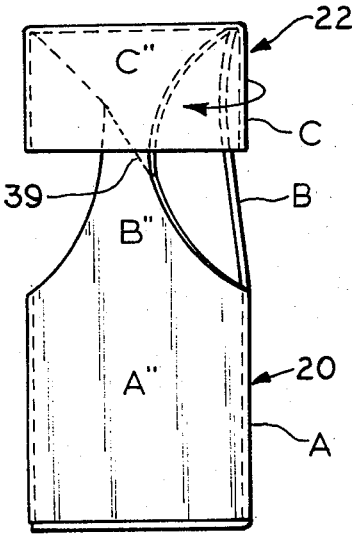
FIGS. 9–11 are side views of the container shown in FIG. 1, illustrating in greater detail the position of the closure structure as the container is being closed.
Figure 10:
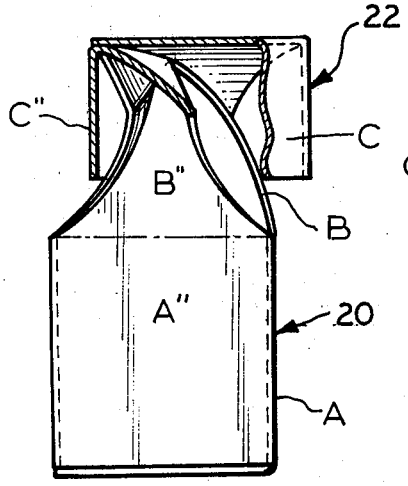

Referring to FIGS. 1–3, a container, designated generally as 20, is shown having three sides and a top. The container 20 is shown in FIG. 1 in the closed position with the closure structure 22 seated in removable engagement with the side walls. In FIGS. 2, 8 and 9 the container 20 is illustrated in the open position with the closure structure 22 displaced upwardly from the container's side walls.

As can be seen from a comparison of FIGS. 2, 3 and 8, the top of the container 20 is composed of a series of inwardly folding portions, B, B′ and B″, which displace outwardly to form part of the container's access passageway when rotated to the open position.

Figure 4:
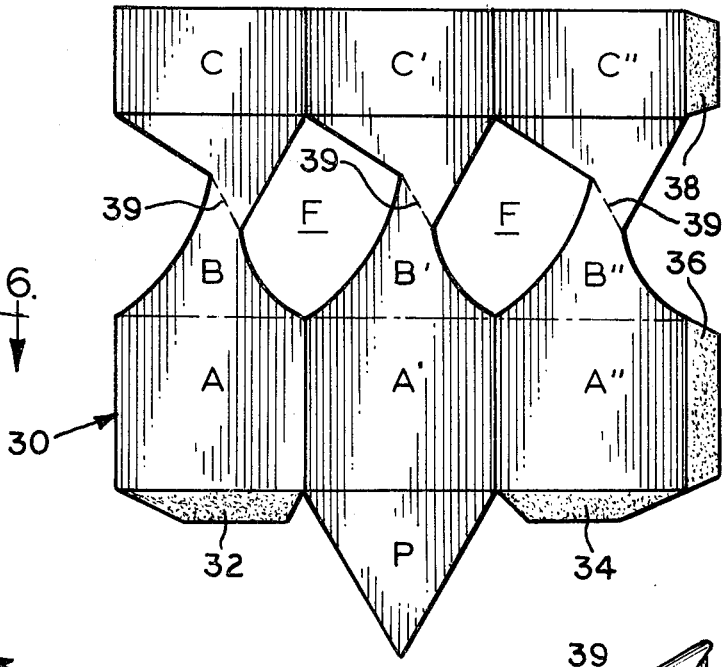
FIG. 4 is a plan view illustrating a cut blank used to construct the container of FIG. 1.

The container 20 utilizing the closure structure 22 can be constructed from a single pre-cut blank, such as blank 30 shown in FIG. 4. The blank 30 has three panels, each of which has a lower portion A, an intermediate portion B and an upper portion C defining its length. It will be appreciated that the number of panels corresponds to the number of sides used for a specific container, a three-sided container being discussed herein solely for purposes of illustration.

The panels of blank 30 make up the side walls of the assembled container 20 and are joined at their lateral edges along the lower portion A and the upper portion C thereof, while being separated along the intermediate portion B by the configured apertures F. Where a bottom is desired the blank 30 will also include a bottom panel P joined to the lower edge of one of the side panels. Of course, the blank 30 may also include fastening tabs 32, 34 36 and 38 which allow for more expeditious assembly, as is well known in the art.

Figure 5:
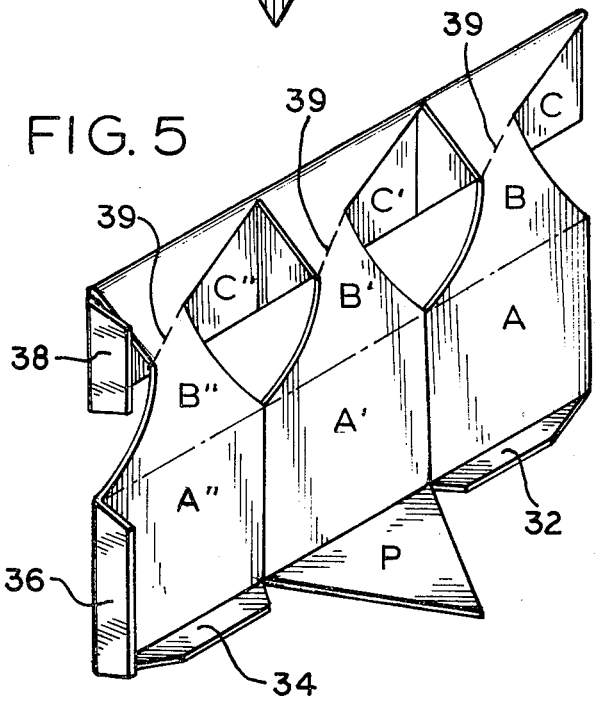
FIG. 5 is a perspective view illustrating an intermediate step in the assembly of the container shown in FIG. 1.
Figure 12:
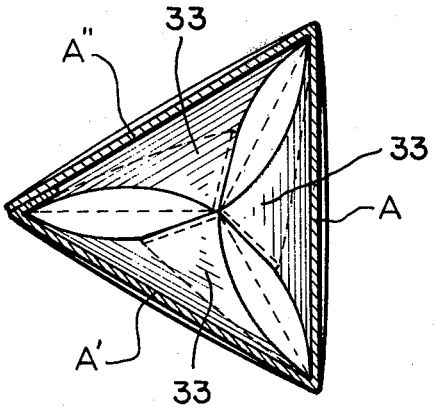
FIG. 12 is a cross-sectional view taken along line 12—12 of FIG. 11.
Figure 7:
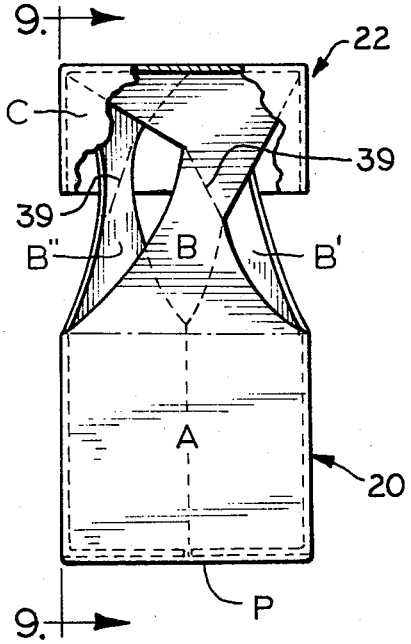
FIG. 7 is a side view, in partial cross-section, taken along line 7—7 of FIG. 2.
Figure 10A:
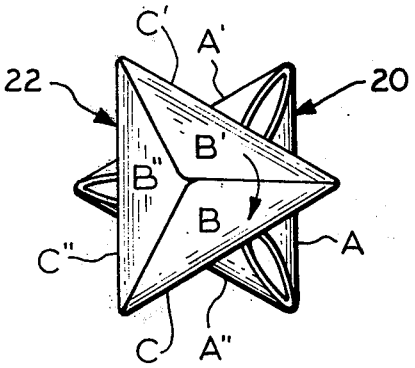
FIGS. 10*a* and 11*a* are top views of FIGS. 10 and 11 respectively.

In the assembled container the lower portions A form the side walls of the container, and the intermediate portions B and the upper portions C together form the closure structure 22. As is clearly shown in FIG. 5, the upper portion C of each panel is folded downwardly over the outside of the intermediate portion B and thereby forms the lateral surface of the closure structure 22. The intermediate portions B are scored along folding lines 39 such that they fold inwardly and interleavingly to form the interior domed surfaces 33 (see FIG. 12) and the exterior surfaces 35 (see FIG. 11*a*) of closing structure 22.

Figure 11A:
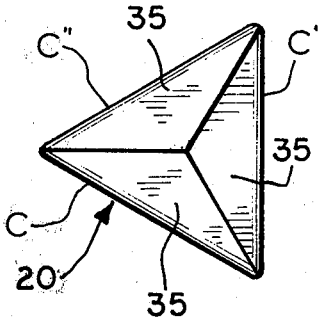
Figure 11:
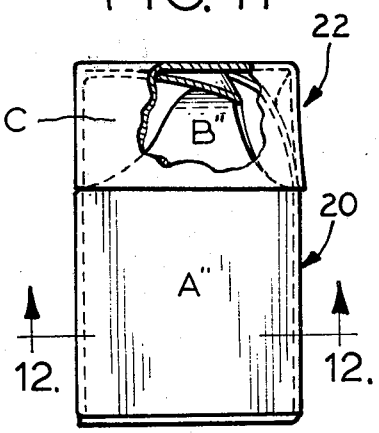

A polyhedral container constructed from the pre-cut blank 30 of FIG. 4 will open and close in response to rotation of the closure structure 22 relative to the side walls A. The mechanism of closing is illustrated in FIGS. 9–11, 10*a* and 11*a*. As the closure structure 22 is rotated in a clockwise direction, as shown above in FIGS. 10 and 10*a*, the intermediate portions B begin to fold inwardly along folding lines 39 and the entire closure structure 22 descends toward the stationary side walls. As the rotation is completed, as shown in FIGS. 11 and 11*a*, the downwardly folded upper portions C seat at the top of the side walls formed from lower portions A.

Figure 13:
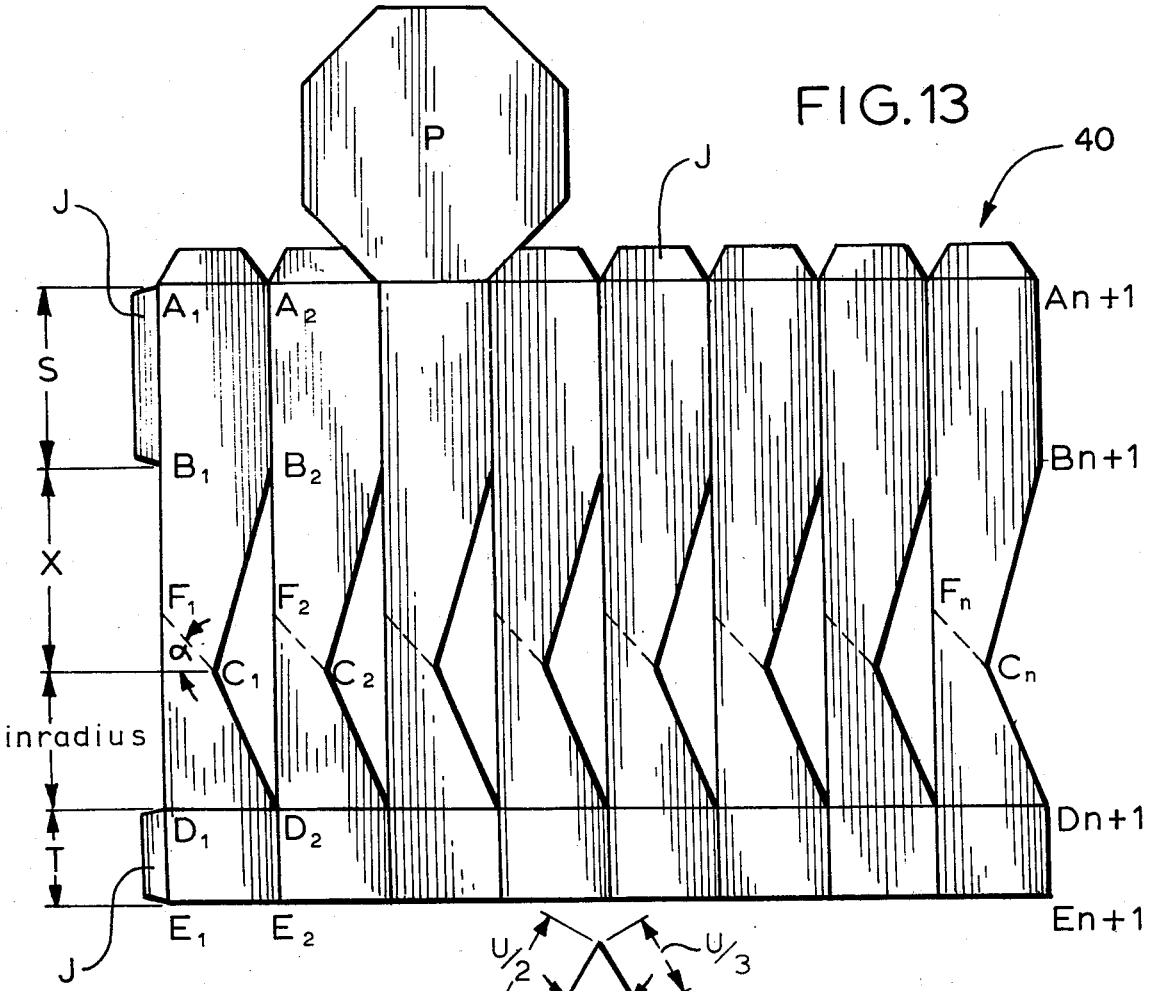
FIG. 13 is a plan view illustrating the general principles of the present invention and the steps required in constructing the pre-cut blank.

A container having the novel closure structure of the present invention may be constructed from a blank 40, shown in FIG. 13, designed in accordance with the following instructions. The relationships expressed hereinbelow apply to the construction of any regular polyhedral container having a height H and $n$ sides, each side having a length $u$:

Determine the side height S (section A of the panels shown in FIG. 4) and top height T (section B) which together equal total height H. As T decreases the closure structure 22 will close, upon rotation, with a tighter spring and the unobstructed inside volume of the container will increase. However, in some instances, as in a three-sided container for example, a very short top height T may be undesirable in that deformation of the container may result.

Next, the angle of rotation through which the closure structure 22 moves between fully opened and fully closed positions is chosen. This angle must be less than 180° and can be only a whole number multiple of $360°/n$. It has been determined that the preferred angle of rotation is that whole number multiple of $360°/n$ which is closest to 90°.

A polygon P having $n$ sides of length $u$ is then constructed and a horizontal base line is extended through one side thereof such that the polygon is above the line as illustrated in FIG. 13. Along this base line and adjacent the polygon, $n-1$ additional segments are marked off each of length $u$. These points are then marked $A_1$, $A_2$, . . . $A_{n+1}$. To form a container which closes with a clockwise rotation of the closure structure, these points should be labelled from left to right; for a container which closes upon counterclockwise rotation, these points should be labelled from right to left.

From points $A_1$, $A_2$, . . . $A_{n+1}$ construct perpendicular lines $A_1B_1$, $A_2B_2$, . . . $A_{n+1}B_{n+1}$ on the opposite side of the base line from the polygon P. The line segments $A_1B_1$, etc. are of a length which equals the height S.

Next, a length $x$ is chosen which is the length of the domed interior 33 of the closure structure 22. The limits for this dimension are:

$$(\text{inradius} + T) > x > \sqrt{T^2 + \text{inradius}^2}$$

where the inradius is the length of a perpendicular bisector extending from any side of the polygon P to its center point. It has been found that a suitable length for $x$ is the average of the limits noted above:

$$\frac{\text{inradius} + T + \sqrt{T^2 + \text{inradius}^2}}{2}$$

Next the points $C_1$, $C_2$, . . . $C_n$ are located. Point $C_1$ lies upon the perpendicular bisector of segment $A_1A_2$ at a distance $S + x$ from its point of intersection with $A_1A_2$. Points $C_2$ $C_n$ are similarly located from segments $A_2A_3$ through $A_nA_{n+1}$.

The lines $A_1B_1$, $A_2B_2$, . . . $A_{n+1}B_{n+1}$ are then extended to points $D_1$, $D_2$, . . . $D_{n+1}$ such that segments $B_1D_1$, $B_2D_2$, . . . $B_{n+1}D_{n+1}$ are each of a length equal to $x$ + inradius.

Similarly, lines $A_1D_1$, $A_2D_2$, . . . $A_{n+1}D_{n+1}$ are extended to points $E_1$, $E_2$, . . . $E_{n+1}$ such that segments $D_1E_1$, $D_2E_2$, . . . $D_{n+1}E_{n+1}$ are each of a length equal to T.

Next, a line is constructed from $C_1$ at an angle $\alpha$ to the horizontal equal to one-half the angle of rotation and which intersects line segment $A_1D_1$ at point $F_1$. Lines $C_2F_2$ through $C_nF_n$ are also constructed in similar fashion. If $F_1$ through $F_n$ lie on line segments AB rather than segments BD, then lines $C_1F_1$ through $C_nF_n$ are to be shortened until $F_1$ through $F_n$ lie below line $B_1B_{n+1}$.

In this case lines $C_1F_1$, etc. will no longer intersect line segments $A_1D_1$, etc.

Having laid out the blank 40 in accordance with these relationships, the areas $C_1B_2D_2$, $C_2B_3D_3$, . . . $C_nB_{n+1}D_{n+1}$ are cut from the blank to form the configured apertures discussed above and lines $C_1F_1$, $C_2F_2$, . . . $C_nF_n$ are preferably scored to improve the folding characteristics of the closure structure. The blank may then be assembled (in the same manner described above with respect to FIG. 5) by the use of the tabs J or other fastening procedures well known in the art.

Figure 14:
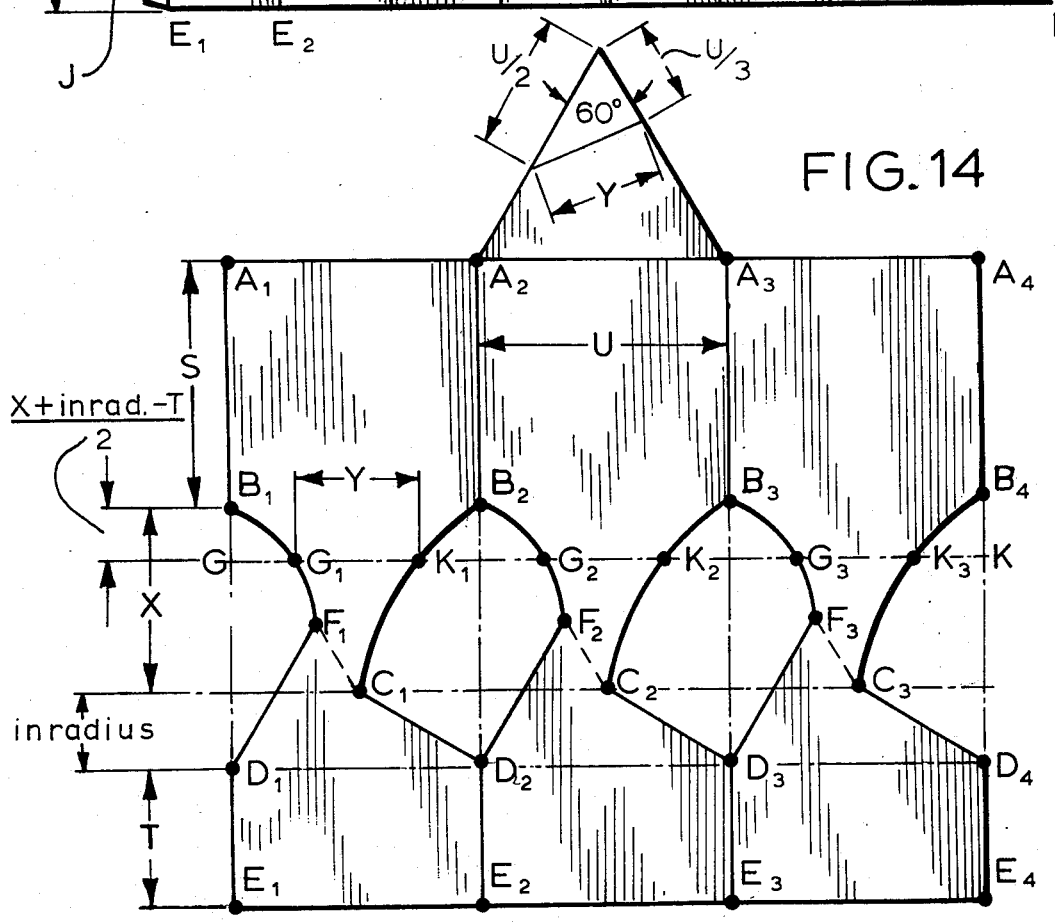
FIG. 14 is a plan view illustrating construction of the blank of FIG. 4.

It will be appreciated that the apertures F of blank 30, shown in FIG. 4, are of a somewhat different configuration than apertures $C_1B_2D_2$, etc. shown in blank 40 of FIG. 14. While a three-sided container, such as container 20 would function if constructed as described above with respect to blank 40, in order to provide full clearance between the downwardly folded portions C and the intermediate portions B during rotation, the following modification shown in FIG. 14 for the configuration of apertures $C_1B_2D_2$, etc. has been determined:

Move points $F_1$, $F_2$ and $F_3$ along lines $C_1F_1$, $C_2F_2$ and $C_3F_3$ such that the angles $F_1D_1D_2$ through $F_3D_3D_4$ are equal to 60°.

Determine length $y$ as shown in FIG. 14 wherein length $y$ is equal to the length of the side of a triangle in which the other two sides are separated by a 60° angle and are of lengths $u/2$ and $u/3$ respectively.

A line GK is then constructed parallel to $A_1A_4$ at a perpendicular distance from $A_1A_4$ equal to $$S + \frac{x + \text{inradius} - T}{2}.$$

Along line GK segments $G_1K_1$ . . . $G_3K_3$ are marked off each having a length $y$ and a center point on the perpendicular bisector of $A_1A_2$, etc. If $G_1K_1$ is greater than or equal to the segment of GK included between lines $F_1B_1$ and $C_1B_2$, then these lines are to be cut as are lines $F_2B_2$, $F_3B_3$, $C_2B_3$ and $C_3B_4$. If, on the other hand, $G_1K_1$ is less than the segment of GK included between lines $F_1B_1$ and $C_1B_2$, then arcs $F_1G_1B_1$, etc. and arcs $C_1K_1B_2$, etc. are to be constructed and cut. Next, lines $D_1F_1$ through $D_3F_3$ and lines $C_1D_2$ through $C_3D_4$ are to be cut forming apertures F.

It will be appreciated from a reading of the foregoing disclosure relating to FIG. 14 that various modifications in the configuration of the apertures for a given container may be desirable. In this regard, and with reference to FIG. 13, it is important to recognize that once the dimensions of the container have been determined, the points B, C and D, as well as angle $\alpha$, must remain fixed. Point F, on the other hand, may be located at any point along the line constructed from C at an angle $\alpha$ from the horizontal, provided neither angle $B_2B_1F_2$ nor angle $D_2D_1F_1$ exceeds the interior angle between any adjacent sides of polygon P. In addition, lines BC, CD, BF and FD may be adapted to a variety of curved and/or straight lines in order to provide variations in the operation and/or appearance of a given container.

The containers and closure structures of the present invention may be constructed from a variety of materials such as paper board, cardboard and the like. In addition, any regular polyhedron can be utilized as the basis for the containers disclosed herein. It has been found that containers made in accordance with the teachings of the present invention have a distinctive appearance and include a snap-type closure mechanism which tends to hold the closure structure in either the open or closed position.

Of course, it will be readily understood by those skilled in the art that other modification and changes may be made to the preferred embodiments discussed hereinabove without departing from the spirit of the present invention or lessening its attendant advantages. Accordingly, such modification or changes are intended to be included within the scope of the appended claims.

I claim:

1. A container comprising at least three panels each having an equal length and an equal width; each said panel being joined at the lateral edges thereof to adjacent panels for a lower and upper portion of said length and separated from adjacent panels for an intermediate portion of said length; said lower portions forming side walls for said container and said intermediate and upper portions forming a closure structure for said container; said panels having angular fold lines across the width of said intermediate portions and being separated at said intermediate portions by apertures having a size and configuration such that upon rotation of the upper portions of said panels relative to the lower portions thereof said intermediate portions fold inwardly to form a top when said container is closed and unfold to form an access passageway when said container is open.

2. The container of claim 1 wherein said intermediate portion of each said panel folds inwardly along one of said fold lines and overlaps the intermediate portions of the adjacent panels upon said rotation to the closed position.

3. The container of claim 1 wherein the upper portions of said panels fold downwardly on the outside of said intermediate portions and said upper portions are of sufficient length to enclose said apertures when the container is in the closed position.

4. The container of claim 1 wherein the angle of rotation between fully open and fully closed positions is equal to or a whole number multiple of 360° divided by the number of said panels and is less than 180°.

5. The container of claim 4 wherein the angle of rotation is the whole number multiple of 360° divided by the number of said panels closest to 90°.

* * * * *